US010739064B2

(12) United States Patent
Douglas et al.

(10) Patent No.: US 10,739,064 B2
(45) Date of Patent: Aug. 11, 2020

(54) COOLING SYSTEM

(71) Applicant: Heatcraft Refrigeration Products LLC, Stone Mountain, GA (US)

(72) Inventors: Jonathan David Douglas, Columbus, GA (US); Kristal Chante Parker, Phenix City, AL (US); Richard Carl Wise, St. Gardner, KS (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 179 days.

(21) Appl. No.: 16/100,483

(22) Filed: Aug. 10, 2018

(65) Prior Publication Data

US 2020/0049400 A1 Feb. 13, 2020

(51) Int. Cl.

| | |
|---|---|
| ***F25D 25/04*** | (2006.01) |
| ***F25B 13/00*** | (2006.01) |
| ***F25B 49/02*** | (2006.01) |
| ***F25D 25/00*** | (2006.01) |

(52) U.S. Cl.

CPC ..... *F25D 25/04* (2013.01); *F25B 13/00* (2013.01); *F25B 49/02* (2013.01); *F25D 25/005* (2013.01)

(58) Field of Classification Search

CPC ..... F25D 25/04; F25D 13/06; F25D 25/005; F25B 13/00; F25B 49/02

See application file for complete search history.

(56) References Cited

U.S. PATENT DOCUMENTS 3,387,464 A 6/1968 Martin
5,317,818 A * 6/1994 Ward ..... B65G 47/54 198/457.02
5,595,263 A * 1/1997 Pignataro ..... B65G 1/1378 186/53
5,595,264 A * 1/1997 Trotta, Jr. ..... A47F 9/047 186/56
7,272,618 B1 * 9/2007 Bisotti ..... G06Q 30/06
7,381,022 B1 * 6/2008 King ..... B65G 1/0492 187/270
7,603,299 B1 * 10/2009 Dewey, Jr. ..... G06Q 10/0631 705/28
9,643,782 B1 * 5/2017 Hall ..... B65G 1/127

(Continued)

FOREIGN PATENT DOCUMENTS

EP 1437566 A1 7/2004

OTHER PUBLICATIONS

European Patent Office, Extended European Search Report, Application No. 19189611.7, dated Dec. 16, 2019, 10 pages.

*Primary Examiner* — Kun Kai Ma

(74) *Attorney, Agent, or Firm* — Baker Botts L.L.P.

(57) ABSTRACT

An apparatus includes a high side heat exchanger, a load, a compressor, a belt, a first bin, a second bin, and a controller. The high side heat exchanger removes heat from a refrigerant. The load uses the refrigerant to cool an enclosed space. The compressor compresses the refrigerant. The first and second bins are coupled to the belt and positioned within the enclosed space. The controller receives a first message, determines that the first bin should be selected, and cycles the belt to move the first bin to a retrieval location within the enclosed space. The controller also receives a second message, determines that the second bin should be selected, and cycles the belt to move the second bin to the retrieval location.

20 Claims, 11 Drawing Sheets

(56) References Cited

U.S. PATENT DOCUMENTS

| | | | | |
|---|---|---|---|---|
| 2005/0143857 | A1* | 6/2005 | Chirnomas | G07F 5/18 700/244 |
| 2007/0041814 | A1 | 2/2007 | Lowe | |
| 2009/0003981 | A1* | 1/2009 | Miller | B65G 1/04 414/267 |
| 2009/0076650 | A1* | 3/2009 | Faes | G07F 11/165 700/232 |
| 2011/0036856 | A1* | 2/2011 | van Ooyen | A47B 57/08 221/123 |
| 2012/0012606 | A1* | 1/2012 | Longley | G07F 11/58 221/92 |

* cited by examiner

COOLING SYSTEM

TECHNICAL FIELD

This disclosure relates generally to a cooling system, such as a refrigeration system or freezer system.

BACKGROUND

Cooling systems may cycle a refrigerant to cool various spaces. For example, a refrigeration system may cycle refrigerant to cool spaces near or around refrigeration loads.

SUMMARY

Cooling systems cycle refrigerant to cool various spaces. For example, a refrigeration system cycles refrigerant to cool spaces near or around refrigeration loads. These cooling systems are used within grocery stores, supermarkets, and other stores to cool goods (e.g., food items) sold in those stores. When cooled, the shelf life of these goods is increased.

To improve convenience for shoppers, many stores have implemented remote or mobile ordering systems in which a customer can use a personal computer or mobile device to order goods from a store (e.g., a grocery store). An employee in the grocery store then retrieves the ordered goods for the customer and places the retrieved goods in a retrieval location in the store. At a subsequent time, the customer travels to the store and picks up the ordered goods. In this manner, the customer does not need to walk through the store to pick out the goods, thus saving time for the customer.

Sometimes, customers order goods that need to be cooled (e.g., refrigerated or frozen). Many stores include separate refrigerators and/or freezer units at the retrieval locations in which these goods are stored for customer pickup. However, these separate refrigerators and freezer units take up space and present an opportunity cost to the store. For example, these refrigerators and freezer units could be used in other places in the store to hold goods that other customers can buy. Additionally, an employee typically must rummage through refrigerators, freezer units, and dry shelves to assemble a customer's order at pickup, resulting in delays and customer dissatisfaction.

This disclosure contemplates an unconventional cooling system that can be implemented at a retrieval location at a store. The cooling system includes an enclosed space cooled by a cooling unit. The cooling unit can cool the space to refrigeration temperatures or to freezer temperatures. A conveyor or carousel system is positioned within the enclosed space. Bins, hooks, and other storage units are coupled to the conveyor or carousel system. An employee stores a customer's ordered goods in these storage units for cooling and for subsequent customer pickup. When the goods are loaded into the storage system, the employee uses a computerized system to link the customer's order with specific storage locations. When the customer arrives at the store for pickup, the store employee can enter the order code into the computerized system. The system can then activate the conveyor or carousel system to cycle the various storage units such that the unit with the customer's goods is moved to a retrieval location within the enclosed space. The employee then retrieves the customer's goods at the retrieval location. In this manner, the grocery store can quickly and efficiently assemble a customer's stored order. Additionally, the cooling system does not require the store to repurpose its own refrigeration and freezer units to store the customer's order, thus allowing the store to use those units to hold other goods within the store. Certain embodiments of the cooling system will be described below.

According to one embodiment, an apparatus includes a high side heat exchanger, a load, a compressor, a belt, a first bin, a second bin, and a controller. The high side heat exchanger removes heat from a refrigerant. The load uses the refrigerant from the high side heat exchanger to cool an enclosed space. The compressor compresses the refrigerant from the load. The belt is positioned within the enclosed space. The first bin is coupled to the belt and positioned within the enclosed space. The second bin is coupled to the belt and positioned within the enclosed space. The controller receives a first message, determines based on the first message that the first bin should be selected, and in response to determining that the first bin should be selected, cycles the belt to move the first bin to a retrieval location within the enclosed space. The controller also receives a second message, determines based on the second message that the second bin should be selected, and in response to determining that the second bin should be selected, cycles the belt to move the second bin to the retrieval location.

According to another embodiment, a method includes removing, by a high side heat exchanger, heat from a refrigerant, using, by a load, the refrigerant from the high side heat exchanger to cool an enclosed space, and compressing, by a compressor, the refrigerant from the load. The method also includes receiving, by a controller, a first message, determining based on the first message that a first bin within the enclosed space should be selected, and in response to determining that the first bin should be selected, cycling a belt coupled to the first bin to move the first bin to a retrieval location within the enclosed space. The belt is positioned within the enclosed space. The method also includes receiving, by the controller, a second message, determining based on the second message that a second bin within the enclosed space should be selected, and in response to determining that the second bin should be selected, cycling the belt to move the second bin to the retrieval location.

According to yet another embodiment, a system includes an enclosed space, a high side heat exchanger, a load, a compressor, a belt, a first bin, a second bin, and a controller. The high side heat exchanger removes heat from a refrigerant. The load uses the refrigerant from the high side heat exchanger to cool the enclosed space. The compressor compresses the refrigerant from the load. The belt is positioned within the enclosed space. The first bin is coupled to the belt and positioned within the enclosed space. The second bin is coupled to the belt and positioned within the enclosed space. The controller receives a first message, determines based on the first message that the first bin should be selected, and in response to determining that the first bin should be selected, cycles the belt to move the first bin to a retrieval location within the enclosed space. The controller also receives a second message, determines based on the second message that the second bin should be selected, and in response to determining that the second bin should be selected, cycles the belt to move the second bin to the retrieval location.

Certain embodiments may provide one or more technical advantages. For example, an embodiment reduces the size of cooling units used in customer order pickup locations. As another example, an embodiment allows other refrigeration and freezer units to be used within a store. As yet another example, an embodiment automatically locates and moves a customer's order to a retrieval location. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1A:
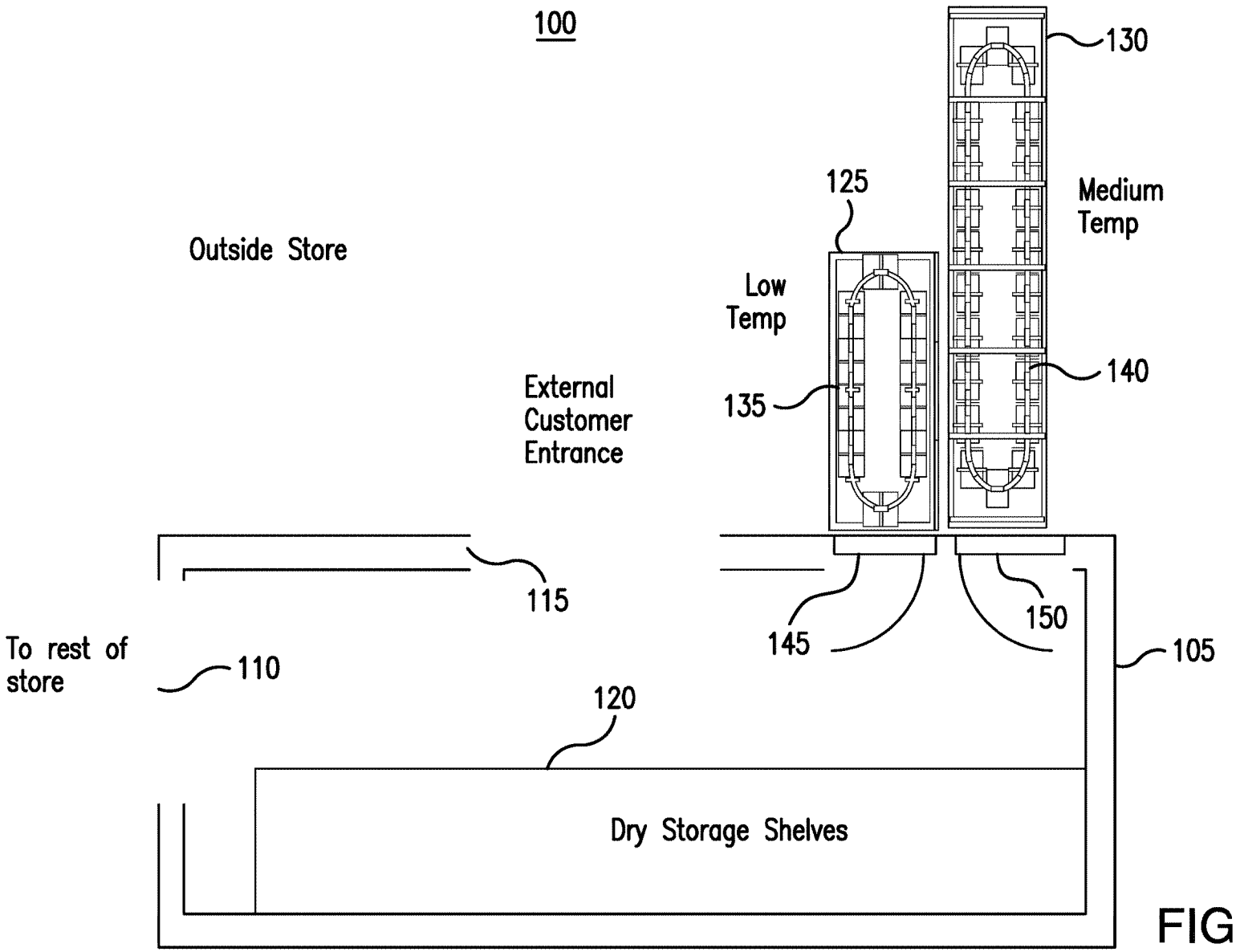
FIGS. 1A-1C illustrate stores with example cooling systems.

Embodiments of the present disclosure and its advantages are best understood by referring to FIGS. 1 through 6 of the drawings, like numerals being used for like and corresponding parts of the various drawings.

Cooling systems cycle refrigerant to cool various spaces. For example, a refrigeration system cycles refrigerant to cool spaces near or around refrigeration loads. These cooling systems are used within grocery stores, supermarkets, and other stores to cool goods (e.g., food items) sold in those stores. When cooled, the shelf life of these goods is increased. Certain goods are cooled to refrigeration temperatures and some goods are cooled to freezing temperatures, which are typically colder than refrigeration temperatures.

Customers typically travel to the store, walk through various aisles and select the goods that they want to purchase. Some customers view this process as inconvenient because of the amount of time it takes for the customers to locate the desired goods. In certain instances, the customers may have extensive shopping lists, thereby requiring the customers to spend a lot of time at the stores. To improve convenience for shoppers, many stores have implemented remote or mobile ordering systems in which a customer can use a personal computer or mobile device to order goods from a store (e.g., a grocery store). An employee in the grocery store then retrieves the ordered goods for the customer and places the retrieved goods in a retrieval location in the store. At a subsequent time, the customer travels to the store and picks up the ordered goods at the retrieval location. In this manner, the customer does not need to walk through the store to pick out the goods, thus saving time for the customer.

Sometimes, customers order goods that need to be cooled (e.g., refrigerated or frozen). Many stores include separate refrigerators and/or freezer units at the retrieval locations in which these goods are stored for customer pickup. However, these separate refrigerators and freezer units take up space and present an opportunity cost to the store. For example, these refrigerators and freezer units could be used in other places in the store to hold goods that other customers can buy. Additionally, an employee typically must rummage through refrigerators, freezer units, and dry shelves to assemble a customer's order at pickup, resulting in delays and customer dissatisfaction.

This disclosure contemplates an unconventional cooling system that can be implemented at a retrieval location at a store. The cooling system includes an enclosed space cooled by a cooling unit. The cooling unit can cool the space to refrigeration temperatures or to freezer temperatures. A conveyor or carousel system is positioned within the enclosed space. Bins, hooks, and other storage units are coupled to the conveyor or carousel system. A store employee stores a customer's ordered goods in these storage units for cooling and for subsequent customer pickup. When the goods are stored in a unit, the employee can scan a code the lets the system know which customer's goods are stored in that unit. When the customer arrives at the store for pickup, an employee can scan a code for the customer. The system can then activate the conveyor or carousel system to cycle the various storage units such that the unit with the customer's goods is moved to a retrieval location within the enclosed space. The employee then retrieves the customer's goods at the retrieval location. In this manner, the grocery store can quickly and efficiently assemble a customer's stored order. Additionally, the cooling system does not require the store to repurpose its own refrigeration and freezer units to store the customer's order, thus allowing the store to use those units to hold other goods within the store. The cooling system will be described in more detail using FIGS. 1 through 6.

Figure 1B:
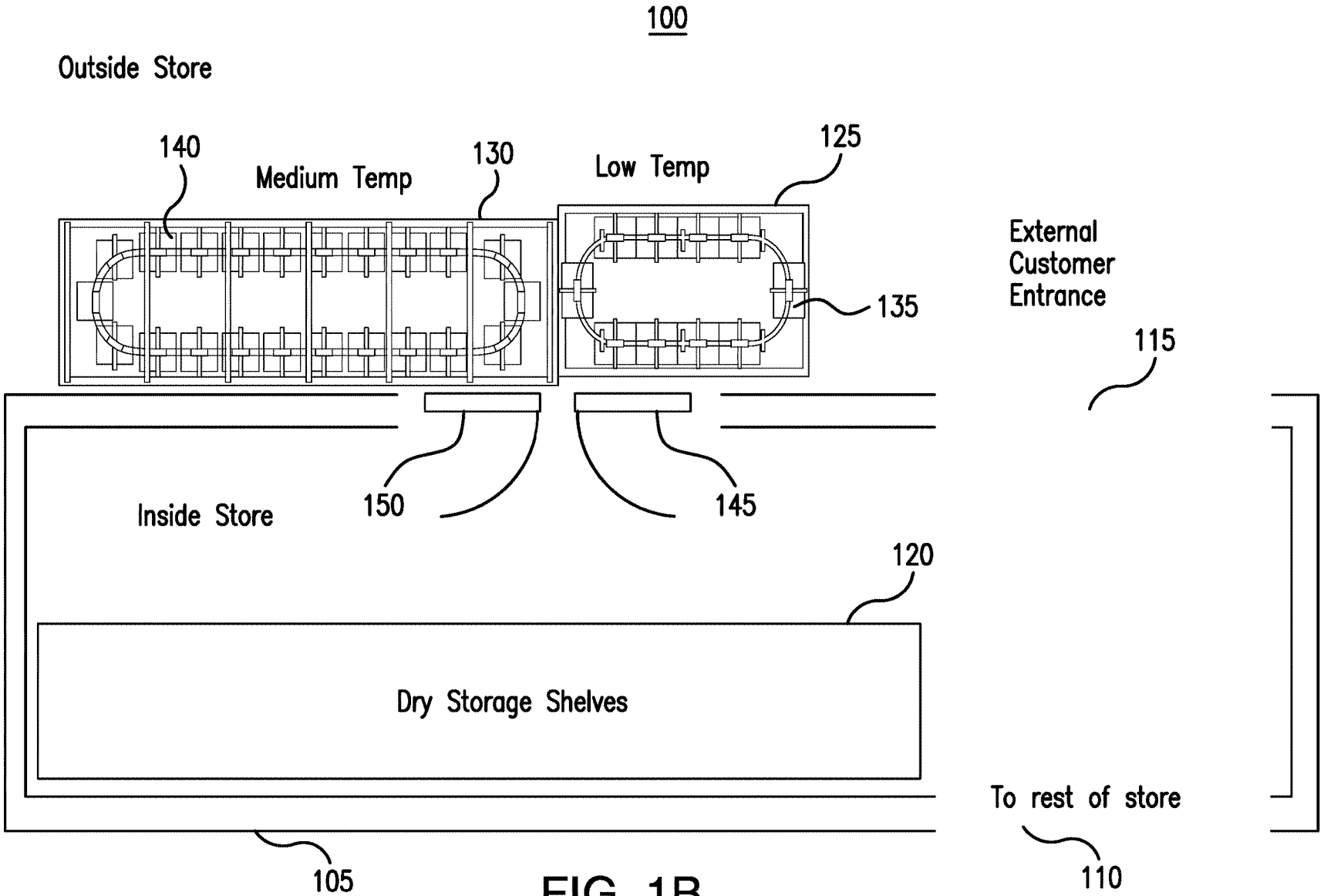
Figure 1C:
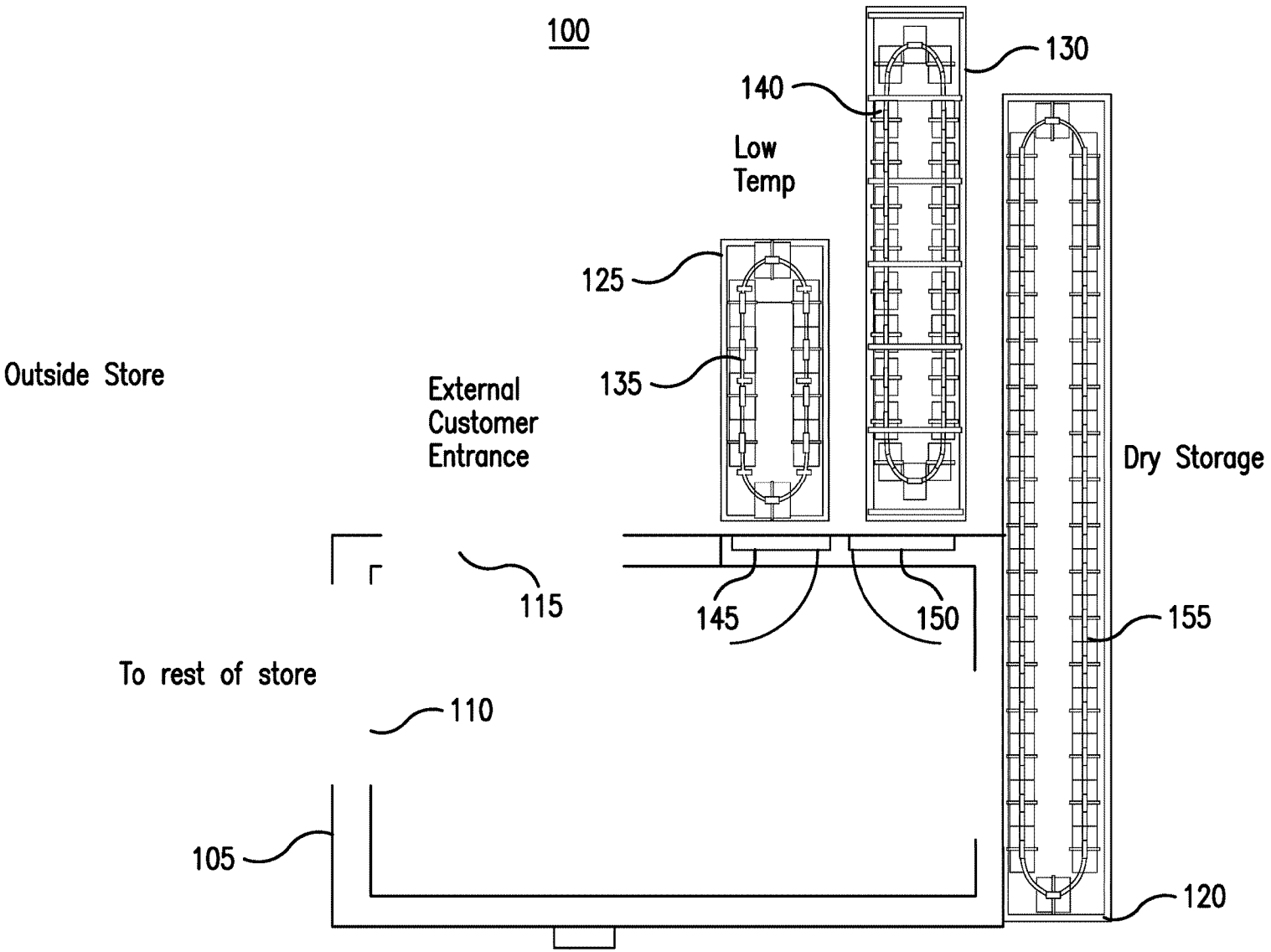

FIGS. 1A through 1C illustrate stores 100 with example cooling systems. Each FIGURE shows a different configuration of the cooling systems for a particular store 100. These configurations are meant merely as examples and are not intended to limit the stores or cooling systems.

FIG. 1A shows a store 100. Store 100 includes, a pick-up area 105, doorways 110 and 115, dry storage shelves 120, a low temperature cooling system 125, and a medium temperature cooling system 130. Generally, customers enter pick-up area 105 through doorways 110 or 115. Customers can then pick up their orders from dry storage shelves 120, low temperature cooling system 125, and/or medium temperature cooling system 130. In some instances, an employee of store 100 can retrieve and assemble the customer's order from dry storage shelves 120, low temperature cooling system 125, and/or medium temperature cooling system 130.

As seen in FIG. 1A, dry storage shelves 120, are positioned along a wall of pick-up area 105, low temperature cooling system 125 and medium temperature cooling system 130 are positioned in a corner of pick-up area 105. If the customer is in another part of store 100, then the customer can enter pick-up area 105 through doorway 110. In many instances, an employee of the store 100 can assemble and then bring a customer's order through doorway 110 to pick-up area 105 for loading. If the customer is outside store 100, then the customer can enter through doorway 115.

Low temperature cooling system 125 includes a storage system 135 and a doorway 145. Generally, storage system 135 holds and/or stores a portion of the customer's order that needs to stay cooled. For example, storage system 135 can store or hold frozen goods. A customer or employee of store 100 operates storage system 135 to move the customer's frozen goods near doorway 145 to a retrieval location. The customer or employee can then enter through doorway 145 and quickly pick up the customer's order.

Similarly, medium temperature cooling system 130 includes a storage system 140 and a doorway 150. Medium temperature cooling system 130 cools goods in storage system 140. Like storage system 135, storage system 140 stores or holds a portion of the customer's order that needs to be cooled. Generally, medium temperature cooling system 130 keeps goods at a higher temperature than low temperature cooling system 125. If low temperature cooling system 125 is a freezer unit, medium temperature cooling system 130 may be a refrigeration unit. As in the previous example, a customer or employee of store 100 can operate storage system 140 to move the customer's order near door 150 to a retrieval location. The customer or employee can then enter through door 150 to retrieve the customer's order.

After the portions of the customer's order are retrieved, they can be assembled and given to the customer. The customer can then leave store 100. In this manner, an employee of store 100 can quickly assemble a customer's order without rummaging through refrigerators and freezers. Additionally, refrigerators and freezers that would otherwise be used in pick-up area 105 can be used instead to cool other goods in store 100.

FIG. 1B illustrates a store 100 with example cooling systems. As seen in FIG. 1B, store 100 includes a pick-up area 105, doorways 110 and 115, dry storage shelves 120, a low temperature cooling system 125, and a medium temperature cooling system 130. These components operate similarly as they did for the store 100 of FIG. 1A. The difference between store 100 of FIG. 1B and store 100 of FIG. 1A is that the store 100 of FIG. 1B has a different configuration for pick-up area 105, dry storage shelves 120, low temperature cooling system 125, and medium temperature cooling system 130. In this configuration, dry storage shelves 120, low temperature cooling system 125, and medium temperature cooling system 130 are positioned in a different corner of pick-up area 105.

FIG. 1C illustrates a store 100 with example cooling systems. As seen in FIG. 1C, store 100 includes a pick-up area 105, doorways 110 and 115, low temperature cooling system 125, medium temperature cooling system 130, and dry storage area 120. A significant difference between store 100 of FIG. 1C and stores 100 of FIG. 1A and FIG. 1B, is that store 100 of FIG. 1C includes a storage system 155 in dry storage area 120. As a result, instead of having dry storage shelves, store 100 of FIG. 1C includes a storage system 155. Storage system 155, can be operated like storage systems 135 and 140. Storage system 155, can hold or store portions of a customer's order that should be placed in dry storage. A customer or an employee of store 100 operates storage system 155 to move the customer's order to a retrieval location in dry storage area 120. The customer or employee can then retrieve the customer's order from dry storage area 120. Dry storage area 120 may include a cooling unit that cools the goods in storage system 155 to a temperature that is higher than both low temperature cooling system 125 and medium temperature cooling system.

In each of the configurations shown in FIGS. 1A through 1C, the lower temperature cooling system 125, medium temperature cooling system 130, and/or dry storage area 120 may have separate cooling units. In this manner, the temperature within each area can be controlled independently of the other areas. In some embodiments, one or more of the cooling systems may share a cooling unit, but generally, each cooling system has its own separate storage system.

Although various configurations have been shown for a store 100, this disclosure contemplates store 100, including any configuration of one or more cooling systems. For example, a store 100 may include only a low temperature cooling system or only a medium temperature cooling system. Additionally, this disclosure contemplates store 100, including any number of storage systems to store or hold customer's orders. By using the cooling systems and storage systems described herein, a store 100 can improve a customer's pick-up experience by allowing an employee to quickly retrieve and assemble a customer's order. Additionally, a store 100 can repurpose refrigerators and freezers that otherwise would be used to store or hold a customer's order. The various cooling systems and storage systems will be further described using the subsequent figures.

FIGS. 2A through 2D illustrate portions of example cooling systems of FIGS. 1A through 1C. Although the cooling systems shown in FIGS. 2A through 2D are labeled as portions of low temperature cooling system 125. These figures show designs that could also be portions of medium temperature cooling system 130 and/or dry storage area 120. In many instances, the cooling unit in these cooling systems can be adjusted to a higher temperature to convert the cooling system from a low temperature cooling system 125 to a medium temperature cooling system 130 and/or dry storage area 120. Thus, the examples shown in FIGS. 2A through 2D can be equally applicable to medium temperature cooling system 130 and/or dry storage area 120, and are not limited to low temperature cooling system 125. In particular embodiments, by using the example cooling systems, a customer's order can be quickly retrieved and assembled.

Figure 2A:
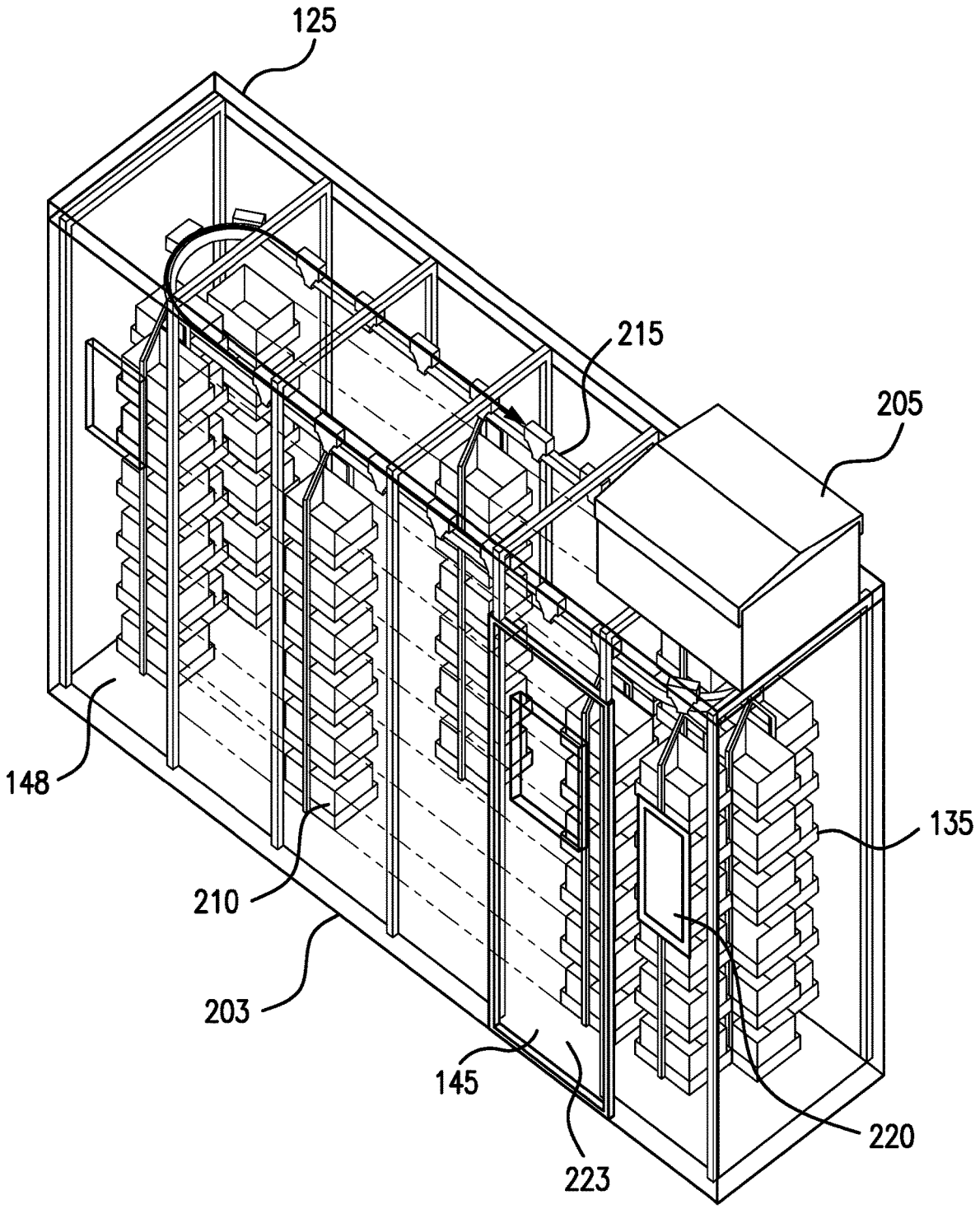
FIGS. 2A-2D illustrate portions of the example cooling systems of FIGS. 1A-1C.

FIG. 2A illustrates a low temperature cooling system 125. As shown in FIG. 2A, low temperature cooling system 125 includes a cooling unit 205, a storage system 135, doorways 145 and 148, and a scanner 220. Generally, an employee can assemble and then load a customer's order into storage system 135 through one of doorways 145 or 148. At pick-up, a customer can use scanner 220 to identify a customer's order. Storage system 135 then activates to move the customer's order to a retrieval location 223 near doorway 145. The customer or employee can then enter doorway 145 to retrieve the customer's order. In some installations, one doorway 145 or 148 is used to load orders and the other doorway 145 or 148 is used to retrieve orders. In this manner, a customer can use a doorway (e.g., doorway 148 to retrieve orders) and an employee can use another doorway (e.g., doorway 145 to load orders). As discussed above, the low temperature cooling system 125 shown in FIG. 2A can be converted to a medium temperature cooling system 130 and/or a dry storage area 120 by adjusting the temperature setting of cooling unit 205.

Cooling unit 205 operates to cool the area enclosed by cooling system 125. As seen in FIG. 2A, walls create an enclosed space 203. Doorway 145 allows a person to enter enclosed space 203. Storage system 135 is positioned within the four walls, and thus, within enclosed space 203. Cooling unit 205, thus, cools the goods stored or held by storage system 135 within enclosed space 203. In the example of FIG. 2A, cooling unit 205 cools enclosed space 203 and the goods in storage system 135 to freezing or below freezing temperatures. Analogously for a medium temperature cooling system or a dry storage area, cooling unit 205 cools enclosed space 203 to refrigeration temperatures (e.g., 35 to 40 degrees Fahrenheit) or even warmer temperatures. Cooling unit 205 will be described in more detail using FIG. 4.

Storage system 135 includes one or more bins 210 coupled to a belt 215. In the example of FIG. 2A, multiple bins 210 hang downwards from belt 215. Belt 215 can be cycled to rotate the bins 210 in a conveyer system. For example, a motor, wheel, or rotary can be activated to cycle belt 215. When a customer's order is scanned by scanner 220, belt 215 can be cycled to move a bin 210 that holds or stores the customer's order to retrieval location 223 near doorway 145. A customer or employee can enter through doorway 145 to retrieve the customer's order from bin 210 at retrieval location 223.

Scanner 220 is any optical reader, such as for example a barcode scanner and/or a QR code reader. A customer or employee can place a code near scanner 220 and scanner 220 scans the code to produce a digital message that contains the code for processing. The code can identify a customer's order or a particular bin 210 within storage system 135. A controller, described using FIG. 6, can process the message and the code to determine a bin 210 holding a corresponding order. The controller can then cycle belt 215 to move the determined bin 210 to retrieval location 223 for pick-up. This disclosure contemplates a cooling system 125 using any suitable input mechanism in lieu of scanner 220. For example, cooling system 125 can include a touchscreen, keyboard, and/or a display that a customer or employee can use to input an identifying code or message into cooling system 125. The controller can use the inputted information to locate a particular bin 210.

Figure 2B:
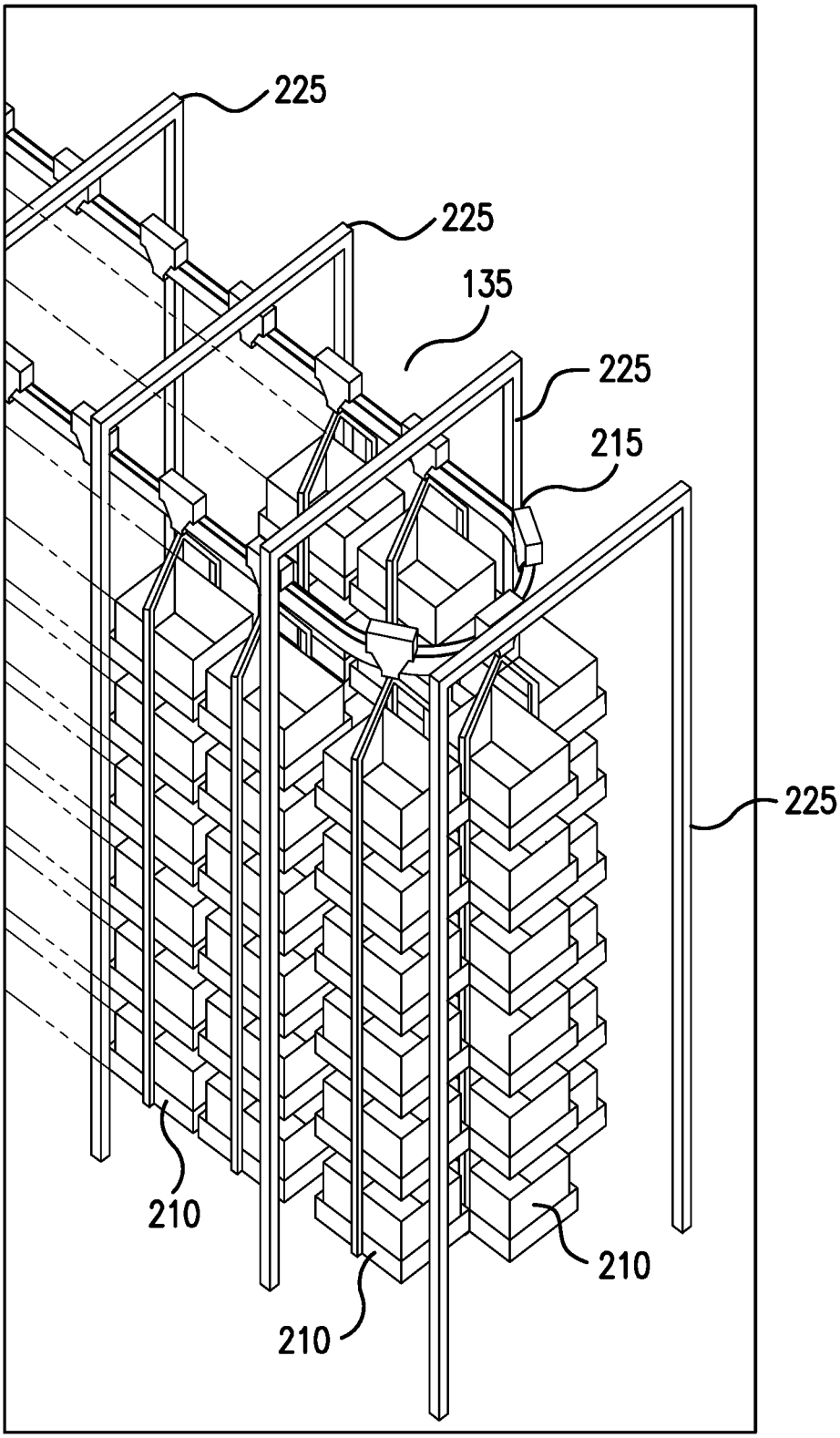

FIG. 2B illustrates storage system 135 of FIG. 2A. As seen in FIG. 2B, storage system 135 includes bins 210 coupled to a belt 215. Belt 215 is positioned above bins 210, and bins 210 hang down from belt 215. One or more frames 225 support belt 215 and bins 210. Belt 215 and bins 210 couple to frame 225, so that they do not collapse to the ground. When activated, belt 215 cycles as in a conveyer system to move the bins to a particular location within cooling system 125.

Figure 2C:
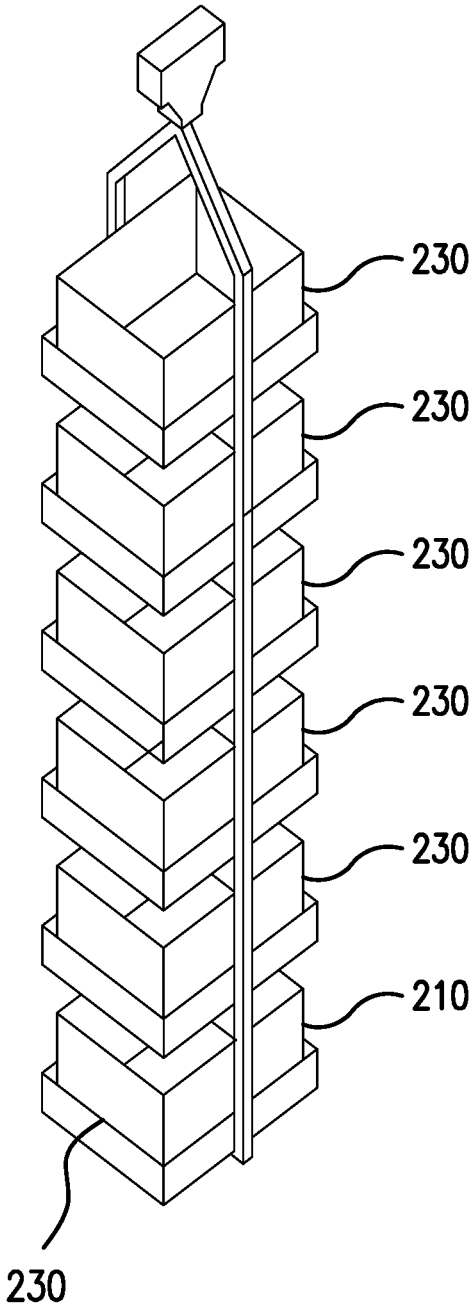

FIG. 2C illustrates the bins 210. As seen in FIG. 2C, bins 210 include one or more storage bins 230. Storage bins 230 are arranged vertically with one another. As a result, bins 210 allow storage of several customer's orders. This disclosure contemplates storage system 135 including any number of bins 210 arranged in any particular manner. This disclosure contemplates bins 210 and storage bins 230 to refer to the same physical items within a storage system. Generally, bins 210 and storage bins 230 may refer to containers that hold a customer's goods for subsequent pick-up.

Figure 2D:
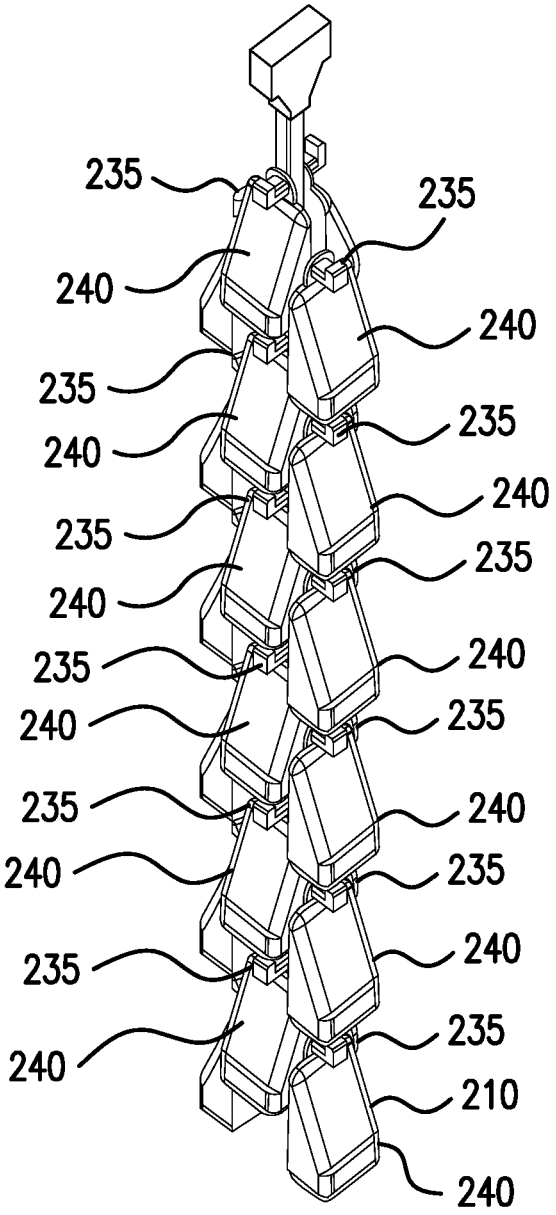

FIG. 2D illustrates an example embodiment that does not include bins 210. Rather, as seen in FIG. 2D, one or more hooks 235 can instead be coupled to belt 215. Grocery bags 240 can engage hooks 235 and hang down from hooks 235. In this manner, a customer or employee can retrieve a customer's order by unhooking a bag 240 holding the customer's order from hook 235. By using bags 240 and hooks 235, the customer or employee does not need to retrieve individual items from a storage bin 230 and assemble the items in a separate bag. This disclosure contemplates storage systems including a mixture of bins 210 and hooks 235. This disclosure contemplates grocery bags 240 being a type of storage bin 230.

Figure 3A:
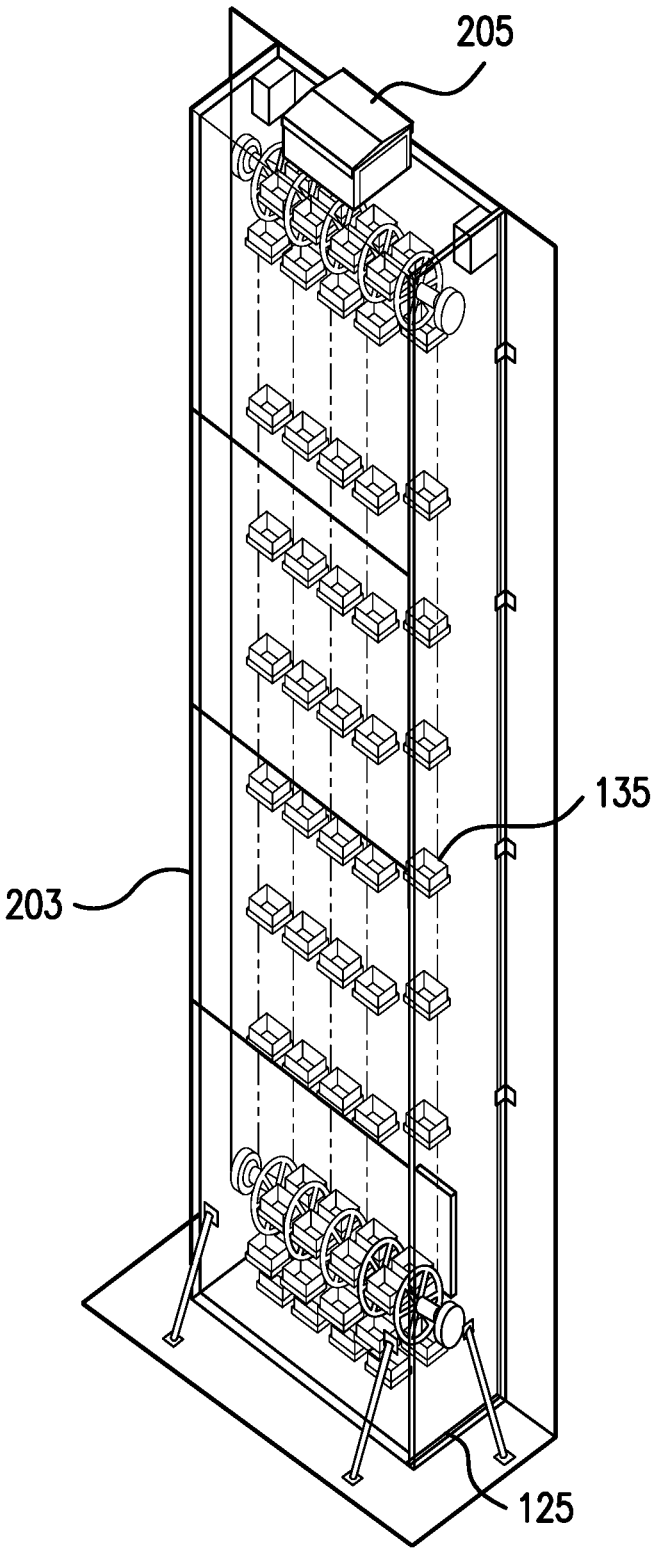
FIG. 3A-3C illustrate portions of the example cooling systems of FIGS. 1A-1C.
Figure 3B:
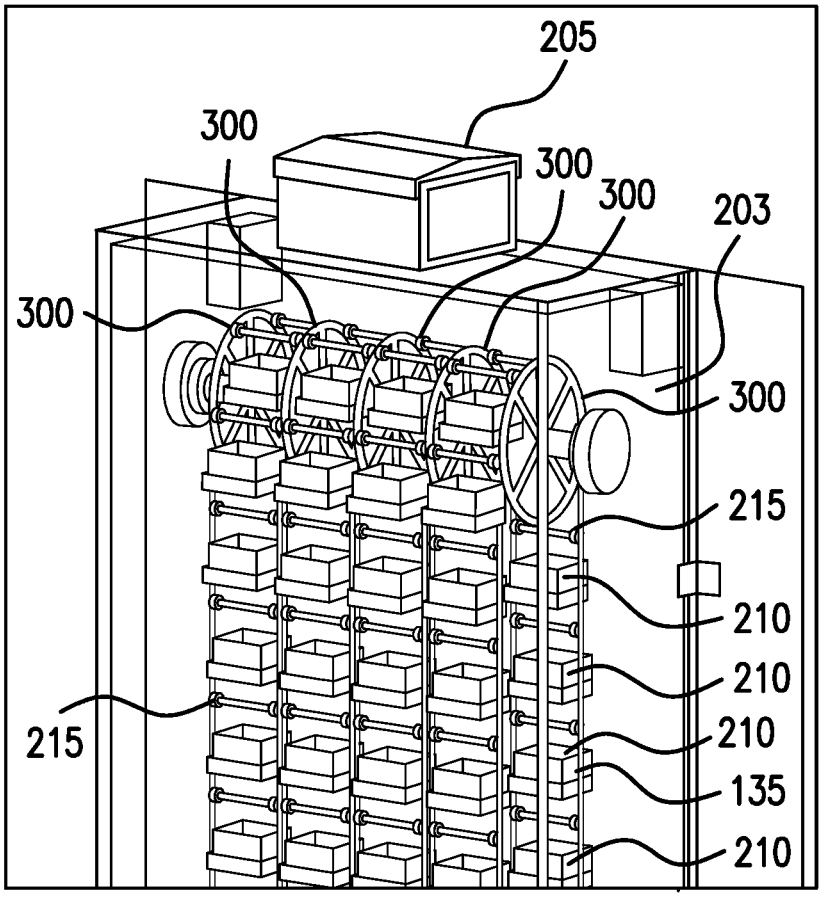
Figure 3C:
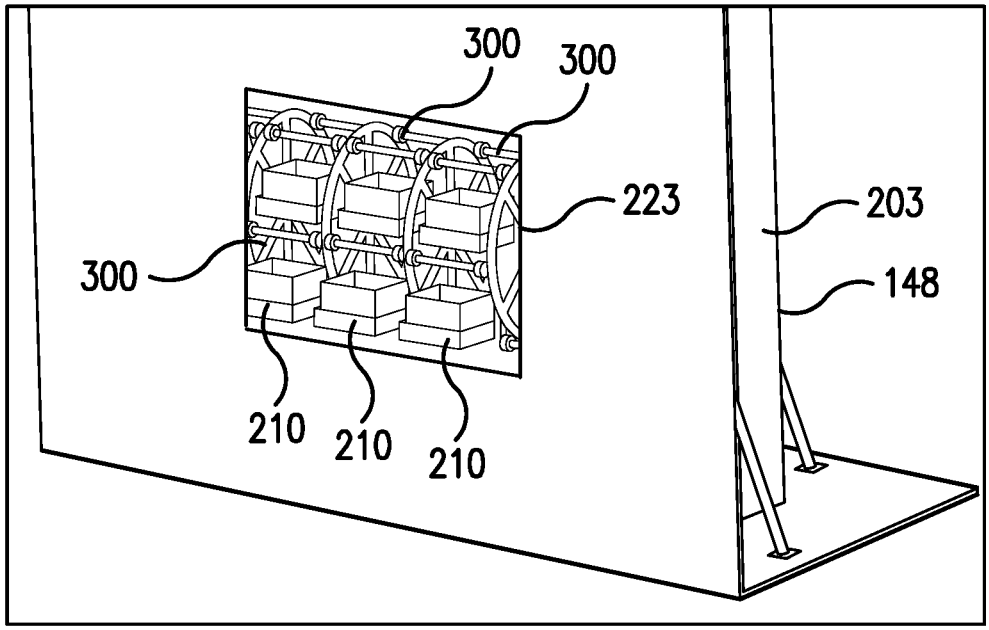

FIGS. 3A through 3C illustrate portions of the example cooling systems of FIGS. 1A through 1C. As with the examples of FIGS. 2A through 2D, the cooling systems shown in FIGS. 3A through 3C could be low temperature cooling system 125, medium temperature cooling system 130, or a dry storage area 120 depending on the temperature setting of cooling unit 205. In some instances, stores 100 may have too little floor space to accommodate the designs shown in FIGS. 2A through 2D. In those instances, a different configuration of the cooling system may be used. Generally, the configurations shown in FIGS. 3A though 3C are vertical configurations for a cooling system. The bins (or hooks and bags) in the cooling system are moved vertically through the system to a retrieval area or slot at the bottom of the system. In this manner, a customer or employee can still quickly retrieve or assemble a customer's order using a cooling system that takes up less floor space.

FIG. 3A illustrates a low temperature cooling system 125. As seen in FIG. 3A, low temperature cooling system 125 includes a cooling unit 205 and a storage system 135. Storage system 135 is arranged vertically in cooling system 125. Although shown as a low temperature cooling system 125, cooling unit 205 can be adjusted to a different temperature, so that the system becomes a medium temperature cooling system 130 or dry storage area 120. Generally, storage system 135 cycles one or more bins vertically through cooling system 125. Storage system 135 is contained within the enclosed space 203 formed by walls. Cooling unit 205 is positioned at the top of the enclosure and cools enclosed space 203.

FIG. 3B illustrates a top portion of cooling system 125. As shown in FIG. 3B, cooling unit 205 is positioned at the top of enclosed space 203 and cools the space within the enclosure. One or more bins 210 are positioned vertically within the enclosure. A belt 215 is coupled to a side of the bins 210. There may be multiple columns of bins 210, and a separate belt 215 may be coupled to a side of each column of bins 210. Each belt 215 is engaged to a wheel or rotary 300. The wheel or rotary 300 can be turned to move the belt 210 vertically through cooling system 125. As the belt 215 is cycled vertically, the bins 210 attached to the belt 215 also move vertically within cooling system 125.

FIG. 3C illustrates a bottom portion of cooling system 125. As seen in FIG. 3C, the bottom portion of cooling system 125 includes a retrieval location 223, where a customer or employee can retrieve goods stored in bins 210 near retrieval location 223. In the example of FIG. 3C, retrieval location 223 may be a slot through which a customer or employee can reach to access bins 210. Additionally, rotaries and/or wheels 300 are positioned along the bottom portion of cooling system 125. These wheels or rotaries 300 can be turned to cycle belt 215, and to move bins 210 vertically, through cooling system 125. By cycling the belt and moving bins 210 near retrieval location 223, a customer or employee can access goods stored in bins 210.

As discussed with previous embodiments, cooling system 125 can include a scanner or other suitable input mechanism by which a user can identify an order to cooling system 125. A controller can use the identifying information (e.g., a code or order number) to locate a bin 210. The controller can then activate the wheels or rotaries 300 to cycle belt 215 to move the located bin 210 to retrieval location 223 for pick-up. Additionally, cooling system 125 can include a doorway 148 or a second slot on another side of cooling system 125. An employee can use a slot (e.g., the illustrated slow) to load orders and a customer can use the other slot or doorway 148 to retrieve orders.

Figure 4:
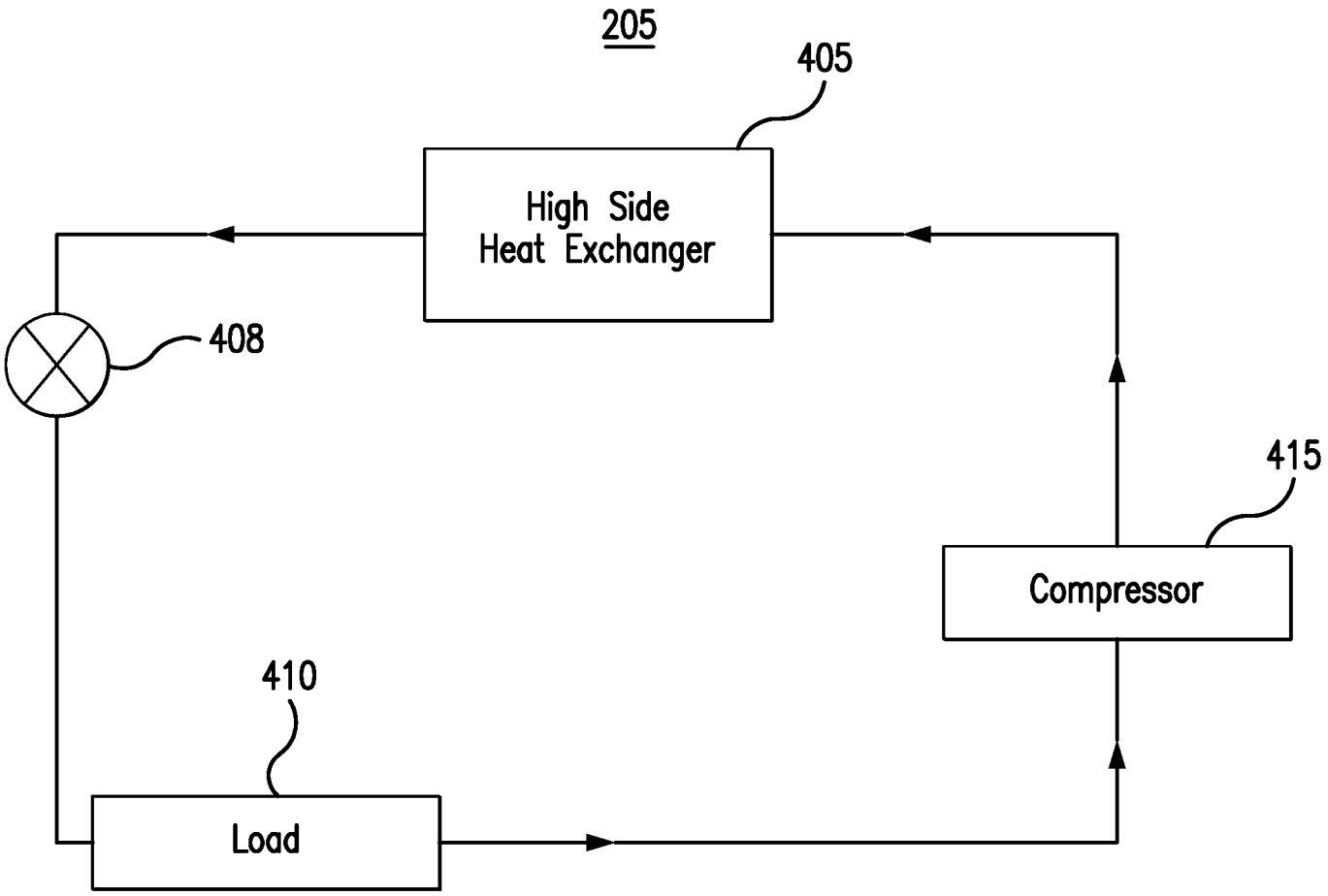
FIG. 4 illustrates an example cooling unit.

FIG. 4 illustrates an example cooling unit 205. As shown in FIG. 4, cooling unit 205 includes a high side heat exchanger 405, a load 410, and a compressor 415. Generally, the components of cooling unit 205 cycle a refrigerant to cool a space proximate load 410, such as for example enclosed space 203.

High side heat exchanger 405 removes heat from a refrigerant. When heat is removed from the refrigerant, the refrigerant is cooled. This disclosure contemplates high side heat exchanger 405 being operated as a condenser, and/or a gas cooler depending upon the refrigerant used. When operating as a condenser, high side heat exchanger 405 cools the refrigerant such that the state of the refrigerant changes from a gas to a liquid. When operating as a gas cooler, high side heat exchanger 405 cools the supercritical refrigerant and the refrigerant remains a gas. In certain configurations, high side heat exchanger 405 is positioned such that heat removed from the refrigerant may be discharged into the air. For example, high side heat exchanger 405 may be positioned on a rooftop so that heat removed from the refrigerant may be discharged into the air. As another example, high side heat exchanger 405 may be positioned external to a building and/or on the side of a building.

Expansion valve 408 controls a flow of refrigerant to load 410. For example, when expansion valve 408 is opened, refrigerant flows to load 410. When expansion valve 408 is closed, refrigerant stops flowing to load 410. In certain embodiments, expansion valve 408 can be opened to varying degrees to adjust the amount of flow of refrigerant to load 410. For example, expansion valve 408 may be opened more to increase the flow of refrigerant to load 410. As another example, expansion valve 408 may be opened less to decrease the flow of refrigerant to load 410.

Expansion valve 408 is used to cool refrigerant entering load 410. Expansion valve 408 may receive refrigerant from any component of cooling unit 205 such as for example high side heat exchanger 405. Expansion valve 408 reduces the pressure and therefore the temperature of the refrigerant. Expansion valve 408 reduces pressure from the refrigerant flowing into the expansion valve 408. The temperature of the refrigerant may then drop as pressure is reduced. As a result, refrigerant entering expansion valve 408 may be cooler when leaving expansion valve 408. The refrigerant leaving expansion valve 408 is fed to load 410.

The refrigerant flows from high side heat exchanger 405 through expansion valve 408 to load 410. The refrigerant cools metallic components of load 410 as the refrigerant passes through load 410. For example, metallic coils, plates, parts of load 410 may cool as the refrigerant passes through them. These cooled components then cool the air around the components. The cooled air can then be circulated (e.g., by a fan) to cool a space, such as enclosed space 203.

Refrigerant flows from load 410 to compressor 415. This disclosure contemplates cooling system 205 including any number of compressors 415. Compressor 415 compresses refrigerant to increase the pressure of the refrigerant. As a result, the heat in the refrigerant may become concentrated and the refrigerant may become a high-pressure gas. As a result, the heat within the refrigerant is easier to remove. Compressor 415 then sends the compressed refrigerant to high side heat exchanger 405 where the heat is removed.

This disclosure may refer to a refrigerant being from a particular component of system 205 (e.g., the refrigerant from the compressor, the refrigerant from the high side heat exchanger, the refrigerant from the load). When such terminology is used, this disclosure is not limiting the described refrigerant to being directly from the particular component. This disclosure contemplates refrigerant being from a particular component (e.g., the compressor) even though there may be other intervening components between the particular component and the destination of the refrigerant. For example, the load receives a refrigerant from the high side heat exchanger even though there may be other components, e.g., an expansion valve, between the high side heat exchanger and the load.

Figure 5:
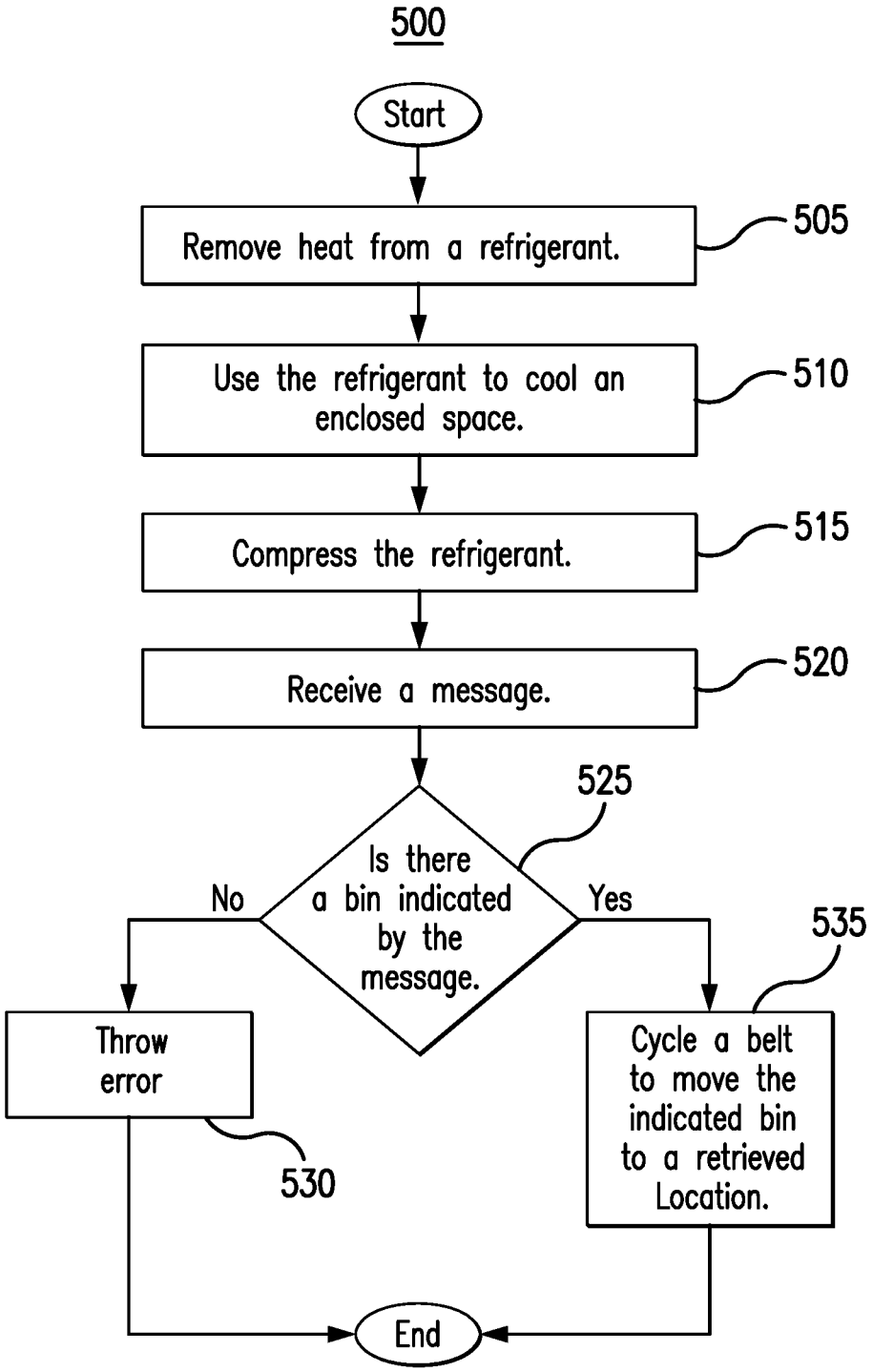
FIG. 5 is a flowchart illustrating a method of operating the example cooling systems of FIGS. 1A-1C and/or 3A-3C.

FIG. 5 is a flow chart illustrating a method 500 of operating the example cooling systems described herein. In particular embodiments, various components of a cooling system perform method 500. By performing method 500, a customer or employee can quickly retrieve and assemble a customer's order in a store.

A cooling unit begins by removing heat from a refrigerant in step 505. A high-side heat exchanger of the cooling unit may perform step 505. In step 510, the cooling unit uses the refrigerant to cool an enclosed space. A load of the cooling unit may perform step 510. In step 515, the cooling unit compresses the refrigerant. A compressor may perform step 515. In this manner, the enclosed space is cooled to refrigeration or freezer temperatures.

A controller of the cooling system receives a message in step 520. The message may be provided by a scanner, QR code reader, keyboard, or touchscreen. In step 525, the controller determines whether there is a bin indicated by the received message. If no bin is indicated by the received message, then the controller throws an error in step 530 to alert a user that a bin was not located. If a bin is indicated by the message, then in step 535, the controller cycles a belt to move the indicated bin to a retrieval location. A user can then retrieve goods stored in the indicated bin at the retrieval location.

Modifications, additions, or omissions may be made to method 500 depicted in FIG. 5. Method 500 may include more, fewer, or other steps. For example, steps may be performed in parallel or in any suitable order. While discussed as a cooling system (or components thereof) performing the steps, any suitable component of the cooling system may perform one or more steps of the method.

Figure 6:
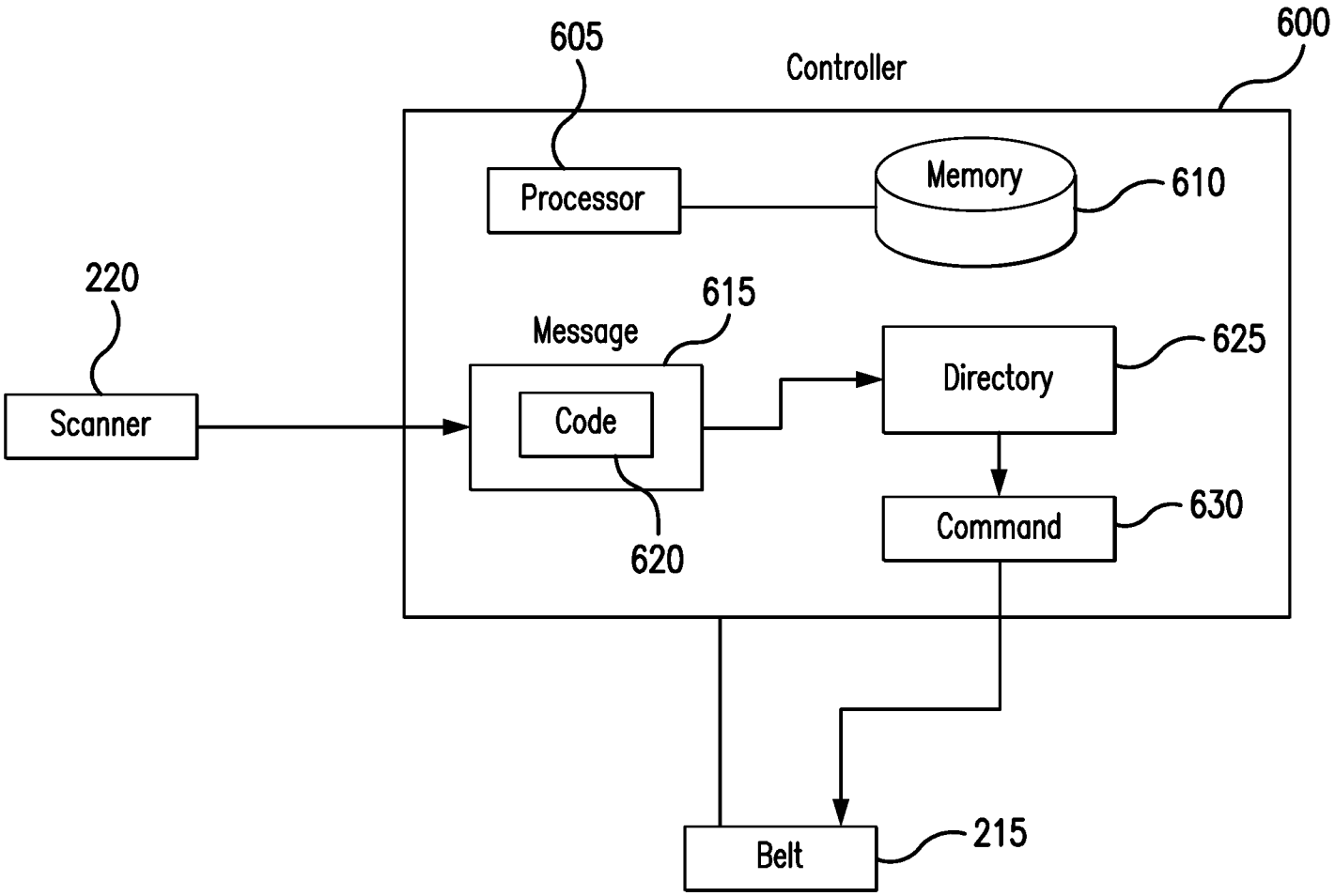
FIG. 6 illustrates a controller of the example cooling systems of FIGS. 1A-1C and/or 3A-3C.

FIG. 6 illustrates a controller 600 of the example cooling systems described herein. As shown in FIG. 6, controller 600 includes a processor 605 and a memory 610. Generally, controller 600 controls the various components of the cooling systems described herein. Such as, for example, cooling units and storage systems. This disclosure contemplates processor 605 and memory 610 being configured to perform any of the operations of controller 600 described herein.

Processor 605 is any electronic circuitry, including, but not limited to microprocessors, application specific integrated circuits (ASIC), application specific instruction set processor (ASIP), and/or state machines, that communicatively couples to memory 610 and controls the operation of controller 600. Processor 605 may be 8-bit, 16-bit, 32-bit, 64-bit or of any other suitable architecture. Processor 605 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 605 may include other hardware and software that operates to control and process information. Processor 605 executes software stored on memory 610 to perform any of the functions described herein. Processor 605 controls the operation and administration of controller 600 by processing information received from various components of a cooling system. Processor 605 may be a programmable logic device, a microcontroller, a microprocessor, any suitable processing device, or any suitable combination of the preceding. Processor 605 is not limited to a single processing device and may encompass multiple processing devices.

Memory 610 may store, either permanently or temporarily, data, operational software, or other information for processor 605. Memory 610 may include any one or a combination of volatile or non-volatile local or remote devices suitable for storing information. For example, memory 610 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 610, a disk, a CD, or a flash drive. In particular embodiments, the software may include an application executable by processor 605 to perform one or more of the functions of controller 600 described herein.

As described previously, a customer or employee can use scanner 220 to scan an identifier for a customer's order. For example, scanner 220 can scan a bar code, QR code, or other identification code that is assigned to a user's order. When scanner 220 scans the code, scanner 220 communicates a message 615 to controller 600. Message 615 includes a code 620 that identifies the customer's order.

Controller 600 receives message 615 and/or code 620, and processes code 620 to issue a command 630. For example, when a customer's order is being loaded into the storage system, code 620 can identify the customer's order. Controller 600 can then assign a bin to code 620. Alternatively, an employee can assign a bin to code 620, and message 615 will indicate the bin assignment. Controller 600 then indicates in a directory 625 the bin and the code 620 assigned to that bin. The employee can place or load the customer's order into the assigned bin for subsequent pickup.

As another example, when a customer comes to retrieve the order the employee or the customer can scan a code for that order. Using scanner 220, controller 600 receives a message 615 with the scanned code 620. The code 620 may indicate that a bin assigned to that code 620 should be selected. Controller 600 then references directory 625 to determine the bin assigned to the scanned code 620. If no bin is assigned to the scanned code 620, then controller 600 can throw an error. If a bin is assigned to code 620, then controller 600 determines that that bin should be selected, generates command 630, and issues command 630 to belt 215. Belt 215 then cycles to move the assigned bin to a retrieval location so that its contents can be retrieved. In some embodiments, controller 600 issues command 630 to activate wheels, motors, and/or rotaries to rotate and cycle belt 215 to move an assigned bin to a retrieval location. The customer or employee can then retrieve the goods in the assigned bin from the retrieval location.

In particular embodiments, code 620 may indicate that a particular hook should be selected. Controller 600 can reference directory 625 to determine that the code 620 is assigned to a hook. Controller 600 then generates and issues command 630 to cycle belt 215 to move the hook to a retrieval location. A customer or employee may then unhook a grocery bag on the hook to retrieve the customer's goods.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a load configured to use the refrigerant from the high side heat exchanger to cool an enclosed space;

a compressor configured to compress the refrigerant from the load;

a belt positioned within the enclosed space;

a first bin coupled to the belt and positioned within the enclosed space;

a second bin coupled to the belt and positioned within the enclosed space; and a controller configured to:

receive a first message;

determine based on the first message that the first bin should be selected;

in response to determining that the first bin should be selected, cycle the belt to move the first bin to a retrieval location within the enclosed space;

receive a second message;

determine based on the second message that the second bin should be selected; and in response to determining that the second bin should be selected, cycle the belt to move the second bin to the retrieval location.

2. The apparatus of claim 1, further comprising a hook coupled to the belt, the controller further configured to:

receive a third message;

determine based on the third message that the hook should be selected;

in response to determining that the hook should be selected, cycle the belt to move the hook to the retrieval location.

3. The apparatus of claim 1, wherein the belt is positioned above the first and second bins.

4. The apparatus of claim 1, further comprising a wheel positioned within the enclosed space, the controller further configured to rotate the wheel to cycle the belt.

5. The apparatus of claim 1, further comprising:

a second high side heat exchanger configured to remove heat from a second refrigerant;

a second load configured to use the second refrigerant from the second high side heat exchanger to cool a second enclosed space separate from the first enclosed space;

a second compressor configured to compress the second refrigerant from the second load;

a second belt positioned within the second enclosed space;

a third bin coupled to the second belt and positioned within the second enclosed space;

a fourth bin coupled to the second belt and positioned within the second enclosed space.

6. The apparatus of claim 1, further comprising a scanner configured to scan a code, the message comprising the code, the code assigned to the first bin, the controller further configured to determine that the first bin should be selected based on the code.

7. The apparatus of claim 1, further comprising a first doorway and a second doorway.

8. A method comprising:
removing, by a high side heat exchanger, heat from a refrigerant;
using, by a load, the refrigerant from the high side heat exchanger to cool an enclosed space;
compressing, by a compressor, the refrigerant from the load;
receiving, by a controller, a first message;
determining based on the first message that a first bin within the enclosed space should be selected;
in response to determining that the first bin should be selected, cycling a belt coupled to the first bin to move the first bin to a retrieval location within the enclosed space, the belt positioned within the enclosed space;
receiving, by the controller, a second message;
determining based on the second message that a second bin within the enclosed space should be selected; and
in response to determining that the second bin should be selected, cycling the belt to move the second bin to the retrieval location.

9. The method of claim 8, further comprising:
receiving, by the controller, a third message;
determining based on the third message that a hook coupled to the belt should be selected;
in response to determining that the hook should be selected, cycling the belt to move the hook to the retrieval location.

10. The method of claim 8, wherein the belt is positioned above the first and second bins.

11. The method of claim 8, further comprising rotating a wheel positioned within the enclosed space to cycle the belt.

12. The method of claim 8, further comprising:
removing, by a second high side heat exchanger, heat from a second refrigerant;
using, by a second load, the second refrigerant from the second high side heat exchanger to cool a second enclosed space separate from the first enclosed space, a second belt, a third bin, and a fourth bin positioned within the second enclosed space, the third and fourth bins coupled to the second belt; and
compressing, by a second compressor, the second refrigerant from the second load.

13. The method of claim 8, further comprising:
scanning a code, the message comprising the code, the code assigned to the first bin; and
determining that the first bin should be selected based on the code.

14. The method of claim 8, further comprising:
opening a first doorway to load the first bin; and
opening a second doorway separate from the first doorway to unload the first bin.

15. A system comprising:
an enclosed space;
a high side heat exchanger configured to remove heat from a refrigerant;
a load configured to use the refrigerant from the high side heat exchanger to cool the enclosed space;
a compressor configured to compress the refrigerant from the load;
a belt positioned within the enclosed space;
a first bin coupled to the belt and positioned within the enclosed space;
a second bin coupled to the belt and positioned within the enclosed space; and
a controller configured to:
receive a first message;
determine based on the first message that the first bin should be selected;
in response to determining that the first bin should be selected, cycle the belt to move the first bin to a retrieval location within the enclosed space;
receive a second message;
determine based on the second message that the second bin should be selected; and
in response to determining that the second bin should be selected, cycle the belt to move the second bin to the retrieval location.

16. The system of claim 15, further comprising a hook coupled to the belt, the controller further configured to:
receive a third message;
determine based on the third message that the hook should be selected;
in response to determining that the hook should be selected, cycle the belt to move the hook to the retrieval location.

17. The system of claim 15, wherein the belt is positioned above the first and second bins.

18. The system of claim 15, further comprising a wheel positioned within the enclosed space, the controller further configured to rotate the wheel to cycle the belt.

19. The system of claim 15, further comprising:
a second enclosed space separate from the first enclosed space;
a second high side heat exchanger configured to remove heat from a second refrigerant;
a second load configured to use the second refrigerant from the second high side heat exchanger to cool the second enclosed space;
a second compressor configured to compress the second refrigerant from the second load;
a second belt positioned within the second enclosed space;
a third bin coupled to the second belt and positioned within the second enclosed space;
a fourth bin coupled to the second belt and positioned within the second enclosed space.

20. The system of claim 15, further comprising a scanner configured to scan a code, the message comprising the code, the code assigned to the first bin, the controller further configured to determine that the first bin should be selected based on the code.

* * * * *